US007249871B2

(12) United States Patent
Chen

(10) Patent No.: US 7,249,871 B2
(45) Date of Patent: Jul. 31, 2007

(54) VERTICAL ADJUSTER FOR SUSPENDING LAMP

(75) Inventor: Meiric Chen, Taiwan Hsien (TW)

(73) Assignee: Seed Lighting Design Co., Ltd., Hsinchuang, Taipei (TW)

( * ) Notice: Subject to any disclaimer, the term of this patent is extended or adjusted under 35 U.S.C. 154(b) by 163 days.

(21) Appl. No.: 11/089,407

(22) Filed: Jun. 14, 2005

(65) Prior Publication Data

US 2006/0291219 A1 Dec. 28, 2006

(51) Int. Cl.
*F21V 21/16* (2006.01)

(52) U.S. Cl. ..... 362/407; 362/404; 362/408; 362/453

(58) Field of Classification Search ..... 362/403–408, 362/429–430, 453, 391, 285, 147–148, 457–458, 362/150, 418, 422, 424, 428; 248/343, 328; 174/44, 45 R, 491
See application file for complete search history.

(56) References Cited

U.S. PATENT DOCUMENTS 5,690,424 A * 11/1997 Warshauer et al. ..... 362/373
7,153,167 B1 * 12/2006 Switzer ..... 439/642

* cited by examiner

*Primary Examiner*—Renee Luebke
*Assistant Examiner*—Robert May

(57) ABSTRACT

A vertical adjuster for a suspending lamp comprises a cylinder at an upper end of the lamp; an inner upper side of the cylinder having a threaded section; a lead wire having one end connected to the lamp and being positioned at a bottom of the cylinder; another end of the lead wire being fixed to a retainer; an adjuster formed by a seat and a slidable annular block; a center of the seat having a hole; the seat being locked to an upper end of the cylinder; the slidable annular block having an axial hole; a lateral side of the slidable annular block having a radial screw hole communicated to the axial hole; a screw unit being located in the screw hole; a cross section of the slidable annular block being slightly larger than that of the hole and the slidable annular block being located below the seat.

3 Claims, 5 Drawing Sheets

VERTICAL ADJUSTER FOR SUSPENDING LAMP

FIELD OF THE INVENTION

The present invention relates to lamps, and particularly a vertical adjuster for a suspending lamp, wherein by easily adjusting the adjuster, the lamp can be retained in a vertical position.

BACKGROUND OF THE INVENTION

In many prior art lamps, the lamps are made glasses. In the manufacturing process of the lamps, the lamps cannot be made with uniform distributed weight so that they are easily to incline to one side. Thereby it is necessary to adjust the lamps in a vertical position. Referring to FIG. 1, it is illustrated that a lead wire 11 is extended from an upper end of the lamp 10. A long sleeve 12 encloses the wire 11. Adjusting the sleeve 12 will make the lamp 20 be in a vertical position. Furthermore, the installation of the sleeve 12 can make a visual effect of causing the viewer to feel the lamp to be in a vertical position. However its effect is not preferred.

SUMMARY OF THE INVENTION

Accordingly, the primary object of the present invention is to provide a vertical adjuster for a suspending lamp, wherein by easily adjusting the adjuster, the lamp can be retained in a vertical position.

To achieve above objects, the present invention provides a vertical adjuster for a suspending lamp which comprises a cylinder at an upper end of the lamp; an inner upper side of the cylinder having a threaded section; a lead wire having one end connected to the lamp and being positioned at a bottom of the cylinder; another end of the lead wire being fixed to a retainer; an adjuster formed by a seat and a slidable annular block; a center of the seat having a hole; the seat being locked to an upper end of the cylinder; the slidable annular block having an axial hole; a lateral side of the slidable annular block having a radial screw hole communicated to the axial hole; a screw unit being located in the screw hole; a cross section of the slidable annular block being slightly larger than that of the hole and the slidable annular block being located below the seat; by the above mentioned feature, the lead wire passing through the axial hole of the slidable annular block and the screw unit screwing into the screw hole so as to combine the slidable annular block and the lead wire; the slidable annular block abutting against a bottom of the seat and supporting a weight of the seat; thus, the weight of the lamp being uniformly distributed upon the slidable annular block to retain the lamp in a vertical position.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
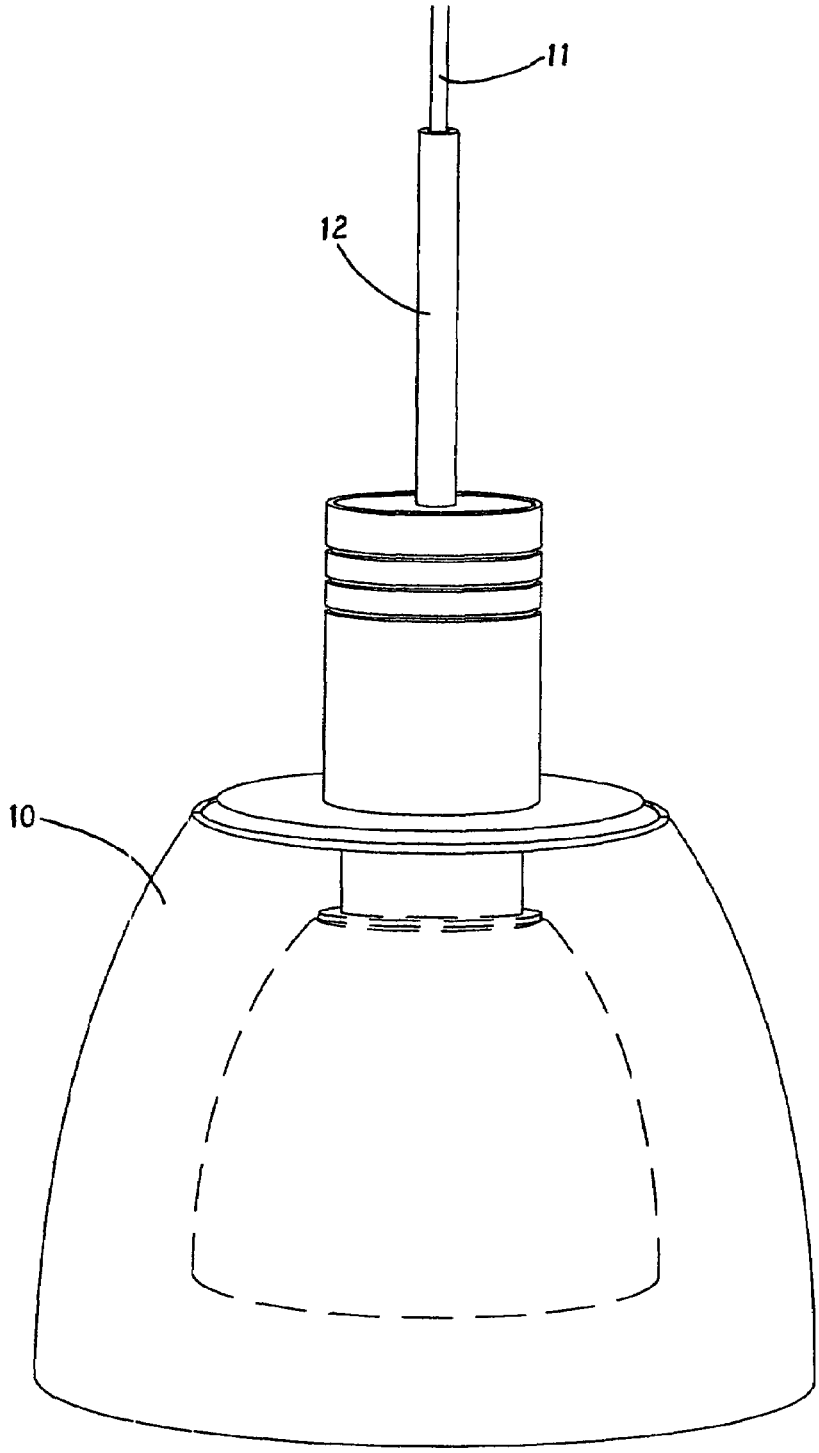
FIG. 1 PRIOR ART
FIG. 1 is a perspective view of a prior art.
Figure 2:
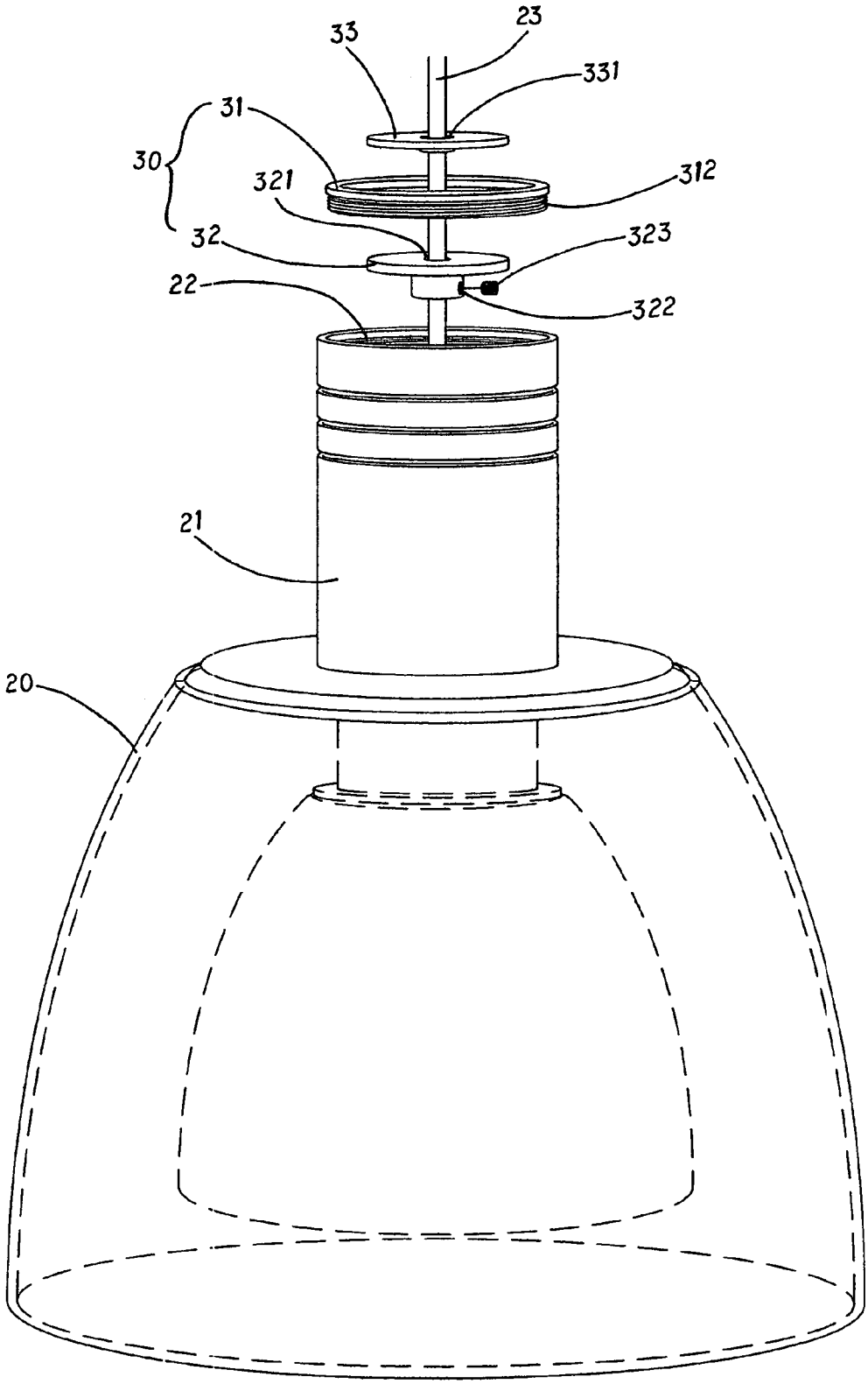
FIG. 2 is an exploded perspective view of the present invention.
Figure 3:
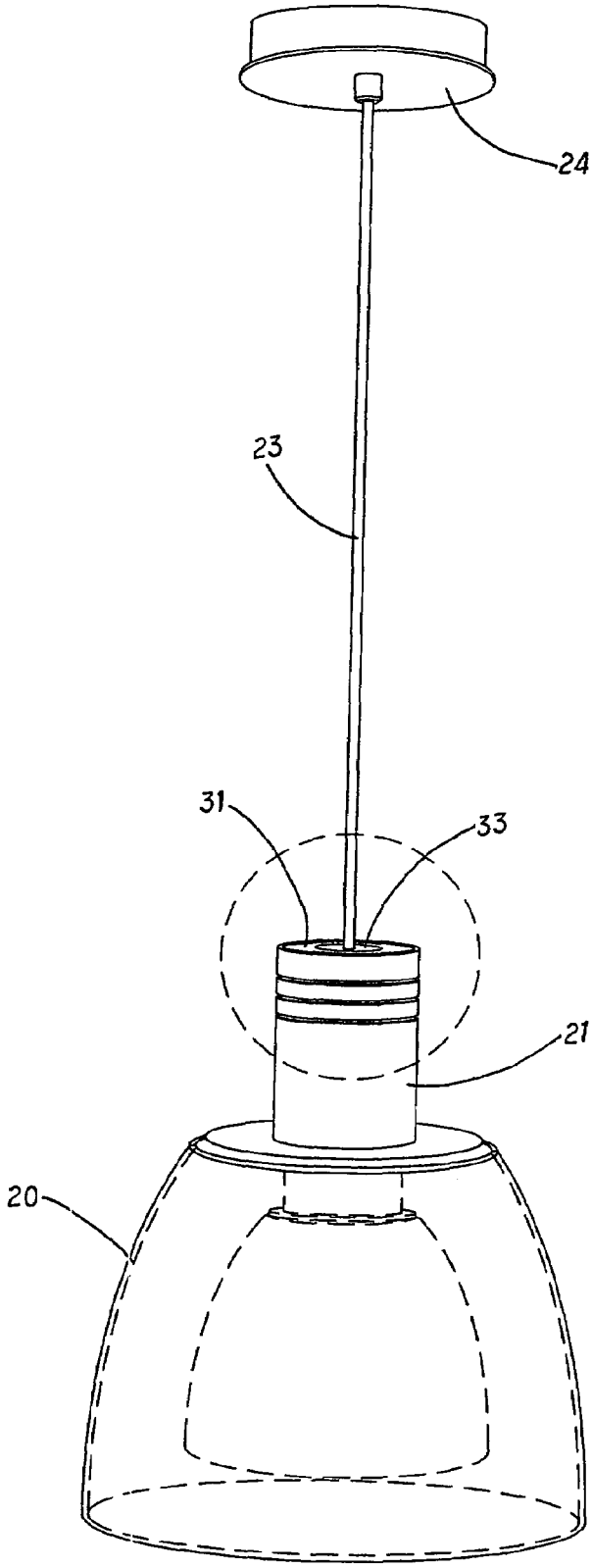
FIG. 3 is a schematic view showing the device of the present invention.
Figure 4:
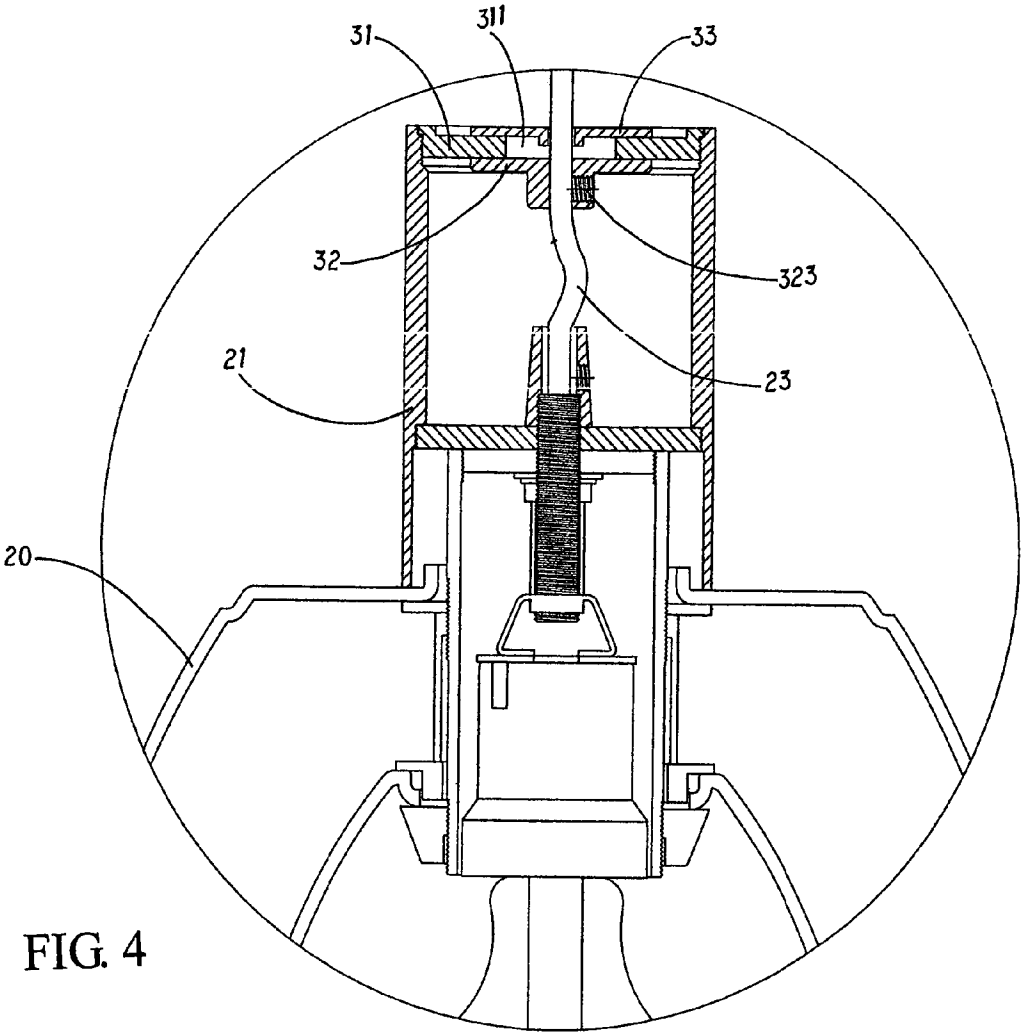
FIG. 4 is a cross sectional view of the present invention.

With reference to FIGS. 2 to 4, the vertical adjuster for a suspending lamp 20 of the present invention is illustrated. The present invention has the following elements.

A cylinder 21 is located at an upper end of the lamp 20. An inner upper side of the cylinder 21 has a threaded section 22.

A lead wire 23 has one end connected to the lamp 20 and is positioned at a bottom of the cylinder 21. Another end of the lead wire 23 is fixed to a retainer 24 so as to suspend the lamp 20.

An adjuster 30 is formed by a seat 31 and a slidable annular block 32. A center of the seat 31 has a hole 311. A periphery of the seat 31 has an outer thread 312 for screwing to the threaded section 22 so as to be locked to an upper end of the cylinder 21. The slidable annular block 32 has an axial hole 321. A lateral side of the slidable annular block 32 has a radial screw hole 322 communicated to the axial hole 321. A screw unit 322 is located in the screw hole 322. A cross section of the slidable annular block 32 is slightly larger than that of the hole 311 and the slidable annular block 32 is located below the seat 31. By the above mentioned feature, the lead wire 23 passes through the axial hole 321 of the slidable annular block 32 and the screw unit 323 screws into the screw hole 322 so as to combine the slidable annular block 32 and the lead wire 23. The slidable annular block 32 abuts against a bottom of the seat 31 and supporting a weight of the seat 31. Thus, the weight of the lamp 20 is uniformly distributed upon the slidable annular block 32 so as to retain the lamp 20 in a vertical position.

Furthermore, a top of the seat 31 of the present invention has a slidable cover 33 corresponding to the slidable annular block 32. The cover 33 has an axial hole 331. The lamp 20 is extended from an upper end of the lamp 20 and then passes through the axial hole 321 of the slidable annular block 32 and the hole 311 of the seat 31, and then through the axial hole 331 of the cover 33 to the retainer 24 so as to suspend the lamp 20. By installing the cover 33 to the seat 31, the lamp 20 has a beautiful outlook and undesired objects cannot fall upon the lamp 20 through the hole 311 of the seat 31.

Figure 5:
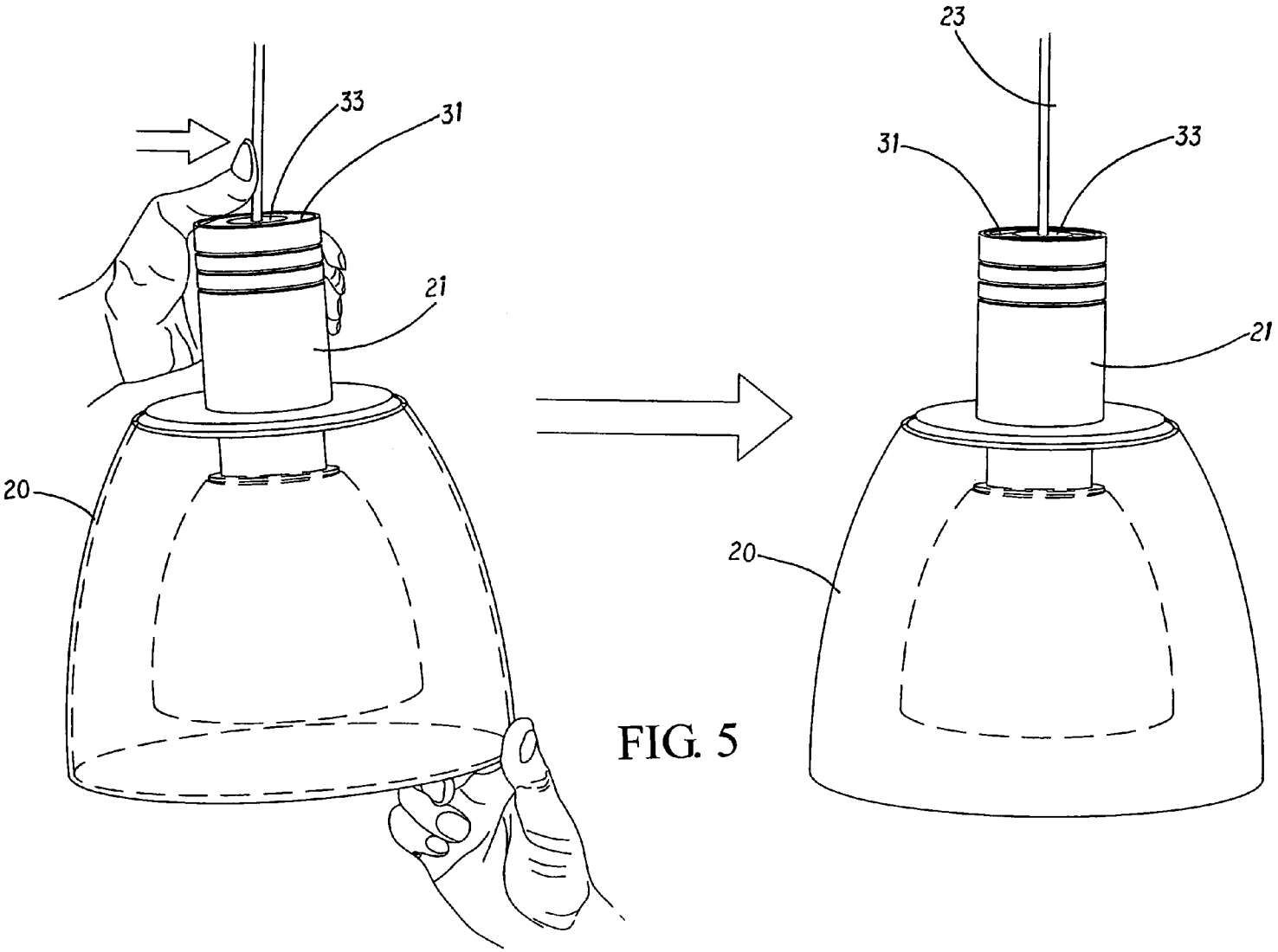
FIG. 5 shows the operation of the adjustment of the lamp to a vertical position.

By the above mentioned structure, the user can push the lead wire 23 to move the cover 33 and drive the slidable annular block 32 at the bottom of the seat 31 (referring to FIG. 5) so that the weight of the lamp 20 can be uniformly distribute upon the slidable annular block 32 so as to retain the lamp 20 in a vertical position.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A vertical adjuster for a suspending lamp comprising:

a cylinder at an upper end of the lamp; an inner upper side of the cylinder having a threaded section;

a lead wire having one end connected to the lamp and being positioned at a bottom of the cylinder;

an adjuster formed by a seat and a slidable annular block; a center of the seat having a hole; the seat being locked to an upper end of the cylinder; the slidable annular block having an axial hole; a lateral side of the slidable annular block having a radial screw hole communicated to the axial hole; a screw unit being located in the screw hole; a cross section of the slidable annular block being slightly larger than that of the hole and the slidable annular block being located below the seat; by the above mentioned feature, the lead wire passing through the axial hole of the slidable annular block and the screw unit screwing into the screw hole so as to combine the slidable annular block and the lead wire; the slidable annular block abutting against a bottom of the seat and supporting a weight of the seat; thus, the weight of the lamp being uniformly distributed upon the slidable annular block so as to retain the lamp in a vertical position.

2. The vertical adjuster for a suspending lamp as claimed in claim 1, wherein a top of the seat has a slidable cover and the cover has an axial hole corresponding to the axial hole of the slidable annular block.

3. The vertical adjuster for a suspending lamp as claimed in claim 1, wherein an inner upper side of the cylinder has a threaded section and a periphery of the seat having an outer thread for screwing to the threaded section so as to be locked to the upper end of the cylinder.

* * * * *